United States Patent [19]

Nakashima

[11] Patent Number: 4,740,388

[45] Date of Patent: Apr. 26, 1988

[54] PAINTING METHOD BY SPRAYING GLASSY MATERIAL

[76] Inventor: Mikio Nakashima, 5693-3, Asahi-ga-oka, Asahi-ga-oka-cho, Owari-Asahi-shi, Aichi-ken, Japan

[21] Appl. No.: 932,243

[22] Filed: Nov. 19, 1986

[51] Int. Cl.[4] ..... B05D 3/10

[52] U.S. Cl. ..... 427/193; 427/330; 427/190; 427/376.4

[58] Field of Search ..... 427/34, 193, 190, 330, 427/376.4, 423

[56] References Cited

U.S. PATENT DOCUMENTS

| | | | |
|---|---|---|---|
| 2,099,340 | 11/1937 | Kautz | 427/330 X |
| 3,696,498 | 10/1972 | Leontaritis | 427/330 X |
| 4,410,598 | 10/1983 | Kuzel et al. | 427/330 |
| 4,582,725 | 4/1986 | Nakashima | 427/204 X |

*Primary Examiner*—Shrive P. Beck

*Attorney, Agent, or Firm*—Armstrong, Nikaido, Marmelstein & Kubovcik

[57] ABSTRACT

A glassy material and painting method comprising exposing a plain surface of a metal material to be painted, applying a vaporizable rust preventive on the surface, and then spraying a powdered glassy material onto the surface thus obtained to form a glassy surface coat.

3 Claims, No Drawings

PAINTING METHOD BY SPRAYING GLASSY MATERIAL

BACKGROUND OF THE INVENTION

1. Field of the Invention

This invention relates to a painting method by spraying glassy materials, more particularly, but not exclusively, to a method of surface treatment of a metal material, such as a building or construction, or building materials.

2. Description of the Prior Art

Surface of metal constructions, such as building, bridges, ships, tanks or pipe lines or the like are usually not subject to any surface treatment, i.e. they are exposed as they are.

However, buildings located near the seaside, or bridges or towers in the water are usually painted with materials of corrosion or rust prevention. The painting layer and the painted surface are, however, subject to secular or aging or deterioration. The aging or deterioration is accelerated particularly in case of a tunnel or an underground passage where the temperature and the humidity are high and the air is dirty.

Furthermore, in order to repair cracked constructions, it is necessary to first remove the outermost surface layer of the portion of the construction that is to be repaired and then clean it so that a new surface appears, and then to fill cracks. After that, the exposed surfaces can be painted or, if necessary tiles can be applied thereto. However, these are time and labour consuming operations.

SUMMARY OF THE INVENTION

The primary object of the present invention is, therefore, to provide a new surface treating method, i.e. an improved glassy material spraying and painting method which can eliminate the above mentioned drawbacks and which can easily coat surfaces of constructions or buildings, or the like with a glassy material, in which the coated surfaces have an increased durability including high waterproof, high weatherability, high light resistance, high corrosion resistance, high heat resistance, and high insulation.

In order to achieve the object of present invention, according to one aspect of the present invention, there is provided a painting method comprising exposing a plain surface of a metal material to be painted, applying a vaporizable rust preventative on the surface, and then spraying a powdered glassy material onto the surface thus obtained to form a glassy surface coat.

DESCRIPTION OF THE PREFERRED EMBODIMENT

The invention will be described in detail with reference to embodiments.

The powdered glass material used in the present invention may be of any powdered material which can make a glasy coating layer by spraying. The powdered glassy material is, for example, glass powder or a raw material of glass, or frit or a raw material or frit, or glaze.

Glaze is widely used for making earthenwares or porcelains. In the present invention, preferably, frit which is obtained when a large part of or all of a raw material of frit are fused at one time. Furthermore, a so-called ground mixture in which only soluble raw material forms in soluble frit and the remaining material is used as being raw can be also advantageously used in the present invention.

Glass powder which contains finely powdered particles (below 44 micron) of glass products can be also advantageously used as the glass powder material.

It is also possible to incorporate metal oxide or pigment into the glassy powder material to easily provided a glassy protecting coat colored with a desired color. The addition of metal oxide increases adhesion properties of the glassy coat to the surface of the building, etc.

The present invention can be applied to an object to be painted which is made a corrosive metal to prevent the glassy coating on the corrosive metal from separating from the metal surface during and after the glassy coating is formed on the corrosive metal surface.

Namely, the present invention is characterized in that the painting method comprises exposing a plain surface of a corrosive metal surface of an object to be painted, for example in a blast process perse known or the like, applying a vaporizable rust preventative on the exposed surface, and then spraying a powdered glassy material onto the surface thus obtained to form a glassy protective layer after the vaporizable rust preventative is sublimated.

In the present invention, the surface of the object to painted, made of a corrosive metal, such as iron is cleaned for example by sandblasting to remove oil, dust and rust therefrom, thereby to expose a clean plain surface. It will be appreciated that the surface of the object can be subject to an acid treatment, for example, by nickel sulphate or cobalt sulphate etc.

After that, an alcoholic solution or the like containing 1 to 30% of a vaporizable rust preventative is applied onto the plain surface by spraying or the like.

The vaporizable rust preventative used in the present invention are dicyclohexyl-ammonium-caprate, isopropyl-ammonium-niterite, cyclohexyl-ammonium-niterite, dicyclohexyl-ammonium-niterite etc. Among them, dicyclohexyl-ammonium-niterite is most useful and usually used.

It is confirmed that no rust occurs on the surface of the object coated with the vaporizable rust preventative for several days, in a natural environment or in the atmosphere, so long as the coating is not removed.

The glassy coat can be formed after the rust preventative is sublimated by heating.

The glassy powders are loaded in a spray gun and is directly sprayed onto the surface of the object coated with the rust preventative. Spraying can be effected, for example, in a gas sprying process or elctric sprying process which is well known.

The thickness of the glassy coat can be optionally selected and is usually about 0.05 to 0.5 mm when the coat is for surface protection. Alternatively, it is even possible to provide a glassy coat having a thickness of about 5 mm.

A couple of examples of the of the invention will be given below.

EXAMPLE 1

An alcoholic solution containing 10% of dicyclohexyl ammonium niterite powder was directly sprayed onto an inner wall of a tank of iron plate which has been subjected to sandblasting treatment. After that, the surface coated with the rust preventative was heated to 200°-250° C. by a gas burner to sublimate the rust preventative coat. Then, the following frit powders (F)

were plasma-sprayed onto the inner wall of the tank to form a glassy surface coat having a thickness of about 0.2 mm.

Frit powders (F): Pellets of No. 401 frit by Toyo Frit Industry Co., Ltd. which were grounded by a dry grinder (EKKUATOMIZER C-20) manufactured by Fuji POWDEL Co., Ltd in Japan to obtain 98% (74 micron) frit powders below 200 meshes.

EXAMPLE 2

A alcoholic solution containing 10% of dicyclohexyl ammonium niterite powder was sprayd onto the inner wall of a tank of iron which has been subjected to sandblasting treatment and acid treatment by applying nickel sulphate thereto after the sandblasting.

After that, the surface coated with the rust preventative was heated to 200°-250° C. by a gas burner to sublimate the rust preventative. After that, cobalt oxide powders were sprayed and then frit powders used in the example 1 mentioned above were plasma-sprayed onto the inner wall of the tank to obtain a glassy surface coat having a thickness of about 0.2 mm.

It is advisable to spray an undercoat made of copper, cobalt, nickel, titanium or zinc, or its alloy or, oxide thereof onto the rust preventative, prior to spraying of the glassy material in order to improve a close contact adhesion between the undercoat and the glassy surface coat to be formed thereon later.

It is also possible to heat again the glassy surface coat thus obtained to 600°-800° C. which is a melting point of the glassy surface coat in order to obtain a smooth and flat surface with good appearance and to further increase the adhesion of the glassy surface coat to the undercoat.

As can be understood from the above discussion, according to the present invention, the glassy powders are sprayed onto the surface of the object, such as a building or construction to form a glassy protection layer thereon. This glassy surface coat contributes to an increase of a durability including high waterproof, high weatherability, high light resistance, high corrosion resistance, high heat resistance and high insulation.

Therefore, the present invention can be advantageously used in particular for a surface treatment of walls of buildings located near the seaside, bridges or towers in the water, or tunnels or underground passages, which walls tend to be easily corroded or become rusty.

Furthermore, the present invention can be advantageously used for a surface treatment of inner walls of pipe lines for delivering liquid, such as oil or water or tanks reserving oil or water etc., with a high chemical resistance.

Among the materials of the glassy powders, the frit and the glaze have, as is well known, properties that the heat expansion coefficencies thereof vary depending on their compositions.

Accordingly, the proper selection of the composition of the glassy powders makes it possible to have the heat expansion coefficiency of the glassy powders close to or substantially identical to that of the outer surface of the building etc. This prevents an occurence of cracks or the like which would otherwise tend to occur.

In addition to the foregoing, according to the present invention, since the glassy powders can be directly sprayed onto the surface of the building etc., the surface treatment is simple and easy. In repairing a cracked portion of the building etc., the glassy powders can be directly sprayed onto the portion of the building that is to be repaired.

What is claimed is:

1. A painting method comprising exposing a plain surface of a metal material to be painted, applying a vaporizable rust preventative on the surface, said vaporizable rust preventative being at least one member selected from the group consisting of dicyclohexyl ammonium caprate, isopropyl ammonium nitrite, cyclohxyl ammonium nitrite, and dicyclohexyl ammonium nitrite, sublimating the rust preventative, and then spraying a powdered glassy material onto the surface thus obtained to form a glassy surface coat.

2. A painting method according to claim 1, wherein said powdered glassy material is a powdered glass.

3. A painting method according to claim 1, wherein said powdered glassy material is frit.

* * * * *